US006615932B2

(12) United States Patent
Huhdanmäki et al.

(10) Patent No.: US 6,615,932 B2
(45) Date of Patent: Sep. 9, 2003

(54) ARRANGEMENT IN ROCK DRILLING APPARATUS

(75) Inventors: Tapani Huhdanmäki, Tampere (FI); Leo Häkkinen, Tampere (FI)

(73) Assignee: Sandvik Tamrock Oy (FI)

( * ) Notice: Subject to any disclaimer, the term of this patent is extended or adjusted under 35 U.S.C. 154(b) by 0 days.

(21) Appl. No.: 09/973,726

(22) Filed: Oct. 11, 2001

(65) Prior Publication Data

US 2002/0036101 A1 Mar. 28, 2002

Related U.S. Application Data

(63) Continuation of application No. PCT/FI00/00308, filed on Apr. 12, 2000.

(30) Foreign Application Priority Data

Apr. 13, 1999 (FI) ..... 990807

(51) Int. Cl.[7] ..... E21B 19/087; E21B 19/20

(52) U.S. Cl. ..... 175/52; 175/85; 173/185

(58) Field of Search ..... 175/52, 85; 414/22.51, 414/22.62, 745.7, 785, 22.54, 22.55; 173/184, 185

(56) References Cited

U.S. PATENT DOCUMENTS

| | | | | |
|---|---|---|---|---|
| 3,506,075 A | * | 4/1970 | Attebo | 173/189 |
| 3,734,208 A | | 5/1973 | Otto | |
| 4,445,579 A | * | 5/1984 | Bello | 175/52 |
| 4,591,007 A | * | 5/1986 | Shaginian et al. | 166/77.53 |
| 4,703,811 A | * | 11/1987 | Lam | 173/164 |
| 4,951,759 A | * | 8/1990 | Richardson | 175/85 |
| 4,974,686 A | | 12/1990 | Hisey et al. | |
| 5,795,107 A | | 8/1998 | Edmondson et al. | |
| 6,374,928 B1 | * | 4/2002 | Teller et al. | 175/52 |

FOREIGN PATENT DOCUMENTS

| | | | | |
|---|---|---|---|---|
| EP | 0 171 368 A1 | | 2/1986 | |
| EP | 0 182 500 A1 | | 5/1986 | |
| EP | 0 819 820 A1 | | 1/1998 | |
| GB | 2083106 A | * | 3/1982 | E21B/19/14 |
| SU | 549 570 | | 3/1977 | |

* cited by examiner

*Primary Examiner*—David Bagnell
*Assistant Examiner*—Daniel P Stephenson
(74) *Attorney, Agent, or Firm*—Burns, Doane, Swecker & Mathis, L.L.P.

(57) ABSTRACT

Arrangement for replacing a drilling component in a rock drilling apparatus, which arrangement comprises a component magazine for storing replaceable components required in drilling and means for driving the drilling unit to a predefined position and location relative to the component magazine. The arrangement further comprises a changing unit for moving the components between the component magazine and the drilling unit.

9 Claims, 3 Drawing Sheets

ARRANGEMENT IN ROCK DRILLING APPARATUS

BACKGROUND AND SUMMARY

This application is a Continuation of International application PCT/FI00/00308 filed on Apr. 12, 2000, which designated the U.S. and was published under PCT Article 21 (2) in English.

The invention relates to an arrangement for changing a drilling component in a rock drilling apparatus comprising a carrier and a boom arranged manoeuvrably to it, to which boom a drilling unit is manoeuvrably arranged, the drilling unit comprising at least a rock drill, a feeding beam and feeding means, and which arrangement further comprises at least one component magazine for storing the drilling components required in drilling and a changing unit for handling the drilling components between the component magazine and the drilling unit.

Extremely heavy stress is directed to a drill bit used in rock drilling, and as a result of it, the drill bit needs occasionally to be changed due to wear and possible damage to it. For efficient rock drilling, a drill bit in good condition is required. In a known solution, the replacing apparatus of the drill bit with its magazine is arranged to the drilling unit. The solution has the drawback, however, that the weight and outer dimensions of the drilling unit necessarily increase in such a solution, whereby handling the drilling unit is difficult and visibility to the object being drilled is poor. A heavy structure requires a robust boom and heavy means for moving the drilling unit, which factors naturally increase the manufacturing costs of the equipment. Further, maintaining the equipment and defining its settings is difficult when the drill bit magazine and the changing unit are arranged tightly to the feeding beam. In addition removing used drill bits and bringing in new ones to the magazine is awkward. Further, it is not in all cases possible to store enough drill bits in the drilling unit, since the weight and outer dimensions of the magazine limit the number of drill bits. Equipment has been developed to solve the above problems, in which equipment the drill bits are already attached to the ends of the drill rods and arranged to a magazine on a carrier. The problem with these solutions is that the rod handling apparatuses require several degrees of freedom in order to be able to move the drill rod with its drill bits from the magazine to the drilling unit. The solution thus requires control of complex movements and the use of expensive and easily damaged components in demanding drilling conditions. Another problem with the solution is that because the drill bits are attached to the drill rods, handling them is awkward due to their large size and weight. In addition, the magazine takes up a lot of space.

It is an object of the present invention to provide a novel arrangement for replacing the drill bit or other drilling component of a rock drill, the invention also avoiding problems occurring in prior art.

The arrangement of the invention is characterized in that the component magazine is arranged to a carrier or boom, separate from the drilling unit, and that the arrangement comprises means for driving the drilling unit to a predefined position and location with respect to the component magazine for replacing the drilling component.

The essential idea of the invention is that the drilling unit with its rock drill and feeding equipment is driven to a predefined location and position with respect to the component magazine for replacing the drilling component. This way, the relative location of the component magazine and the drilling unit driven to a certain replacement position is exactly known. The changing unit is preferably arranged to turn with respect to the carrier or the boom, whereby it is capable of moving the drilling components being replaced between the drilling unit and the magazine. The essential idea of a preferred embodiment of the invention is that the changing unit and the component magazine are arranged to the boom, whereby the movements of the boom do not affect the relative position of the changing unit, component magazine and drilling unit driven to the replacement position. The essential idea of a second preferred embodiment of the invention is that the positioning movements of the changing unit are mechanically restricted.

The invention provides the advantage that replacing the drill bit does not require complex movements of the changing unit, whereby the changing unit can be made structurally simple and, at the same time, reliable. This makes the manufacturing and operational costs of the changing unit low. Complex and fault-sensitive sensor or control apparatuses or an exact control of movements are no longer necessarily needed. The motion speed of simple movements can be made quite high, thus clearly shortening the time needed to replace the drill bit. The solution in question provides the further advantage that when the changing unit and the component magazine are arranged to the carrier or boom, they do not add to the weight and outer dimensions of the drilling unit, thus making handling the equipment easier, allowing a better visibility to the drilling location and in addition, making it possible to design the structures and drives of the drilling unit smaller and, at the same time, less expensive. On the other hand, locating the component magazine to the boom or carrier allows the use of a larger magazine or of several magazines, thus providing a longer uninterrupted operation time of the drilling unit.

BRIEF DESCRIPTION OF THE DRAWING

The invention is described in greater detail in the attached drawings, in which.

DETAILED DESCRIPTION

Figure 1A:
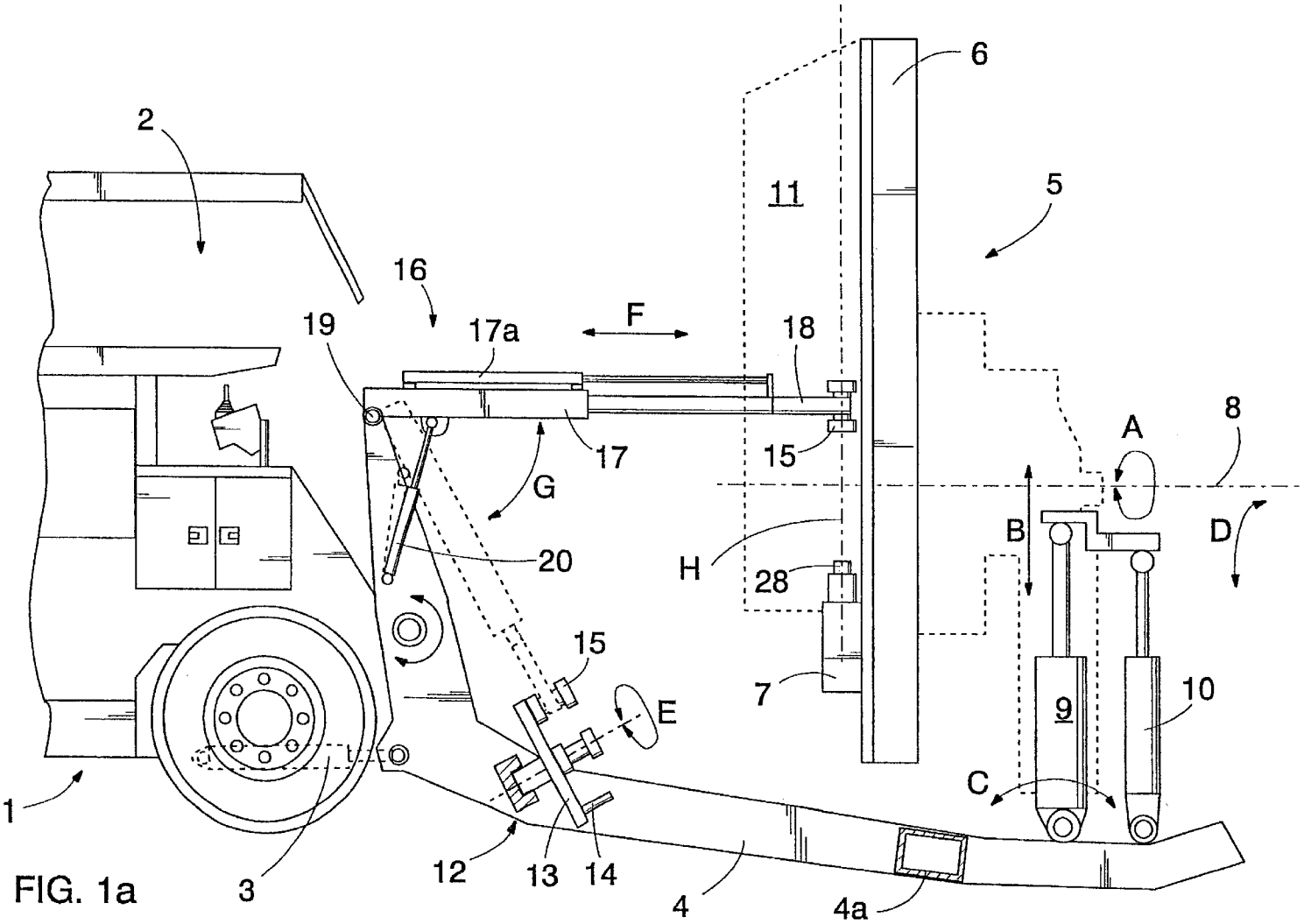
FIGS. 1*a* and 1*b* show schematic views of rock drilling apparatuses to which the arrangement of the invention for replacing a drilling component has been applied.

FIG. 1*a* shows a very simplified view of a part of a rock drilling apparatus in which the application of the solution of the invention is particularly advantageous. It should be noted that in this application, a drilling component refers not only to drill bits but also, for instance, to drill cuttings pipes described later in FIGS. 2*a* and 2*b* and the means required for their installation, as well as other possible components required in drilling and handled with the changing unit. The rock drilling apparatus shown in the figure comprises a manoeuvrable carrier 1 with its control cabin 2 and necessary auxiliary apparatuses. A boom 4 which can be lifted and lowered by means of a hydraulic cylinder 3 is arranged to the carrier 1. The boom 4 is preferably forked, i.e. it comprises two beams longitudinal to the carrier 1 at a distance from each other, which can be lowered against the ground during drilling and correspondingly lifted up at least when the rock drilling equipment is moved. For clarity's sake, the figure shows only the hindmost beam of the boom and the cross-section of a transverse beam 4*a* connecting the beams. An actual drilling unit 5 comprising at least a rock drill 7, a feeding beam 6 and other feeding means is arranged to the boom 4, preferably close to its free end. In the figure, the drilling unit is partly marked with a dashed line. The rock drill 7 is fed by means of hydraulic cylinders, for instance, in the longitudinal direction of the feeding beam 6. The drilling unit 5 can be moved in many different ways relative to the boom 4. Firstly, the entire drilling unit can be turned with a hydraulic motor, for instance, in direction A relative to a horizontal first axis 8. Further, it can be lifted and lowered in direction B by means of a lifting apparatus 9 of the drilling unit, such as a hydraulic cylinder. The drilling unit can also be tilted forward and backward relative to the boom 4 in direction C shown in the figure by means of a tilting cylinder 10 and, further, tilted in the transverse direction D of the rock drill by means of other tilting cylinders not shown herein for clarity's sake. By means of the above moving means, the drilling unit can be directed in a desired manner, whereby it can be used to drill holes in a versatile manner to the ceiling, walls or floor of tunnels, for instance. Keeping the drilling unit in position can be ensured by pressing separate supports against the surface being drilled during drilling. Further, rock bolting or charging equipment can be arranged to the feeding beam, which can be moved to the drilled hole by indexing, for instance, immediately after the drill bit with the drill rod has been moved aside. For drill rods needed in extension rod drilling, a rod drill magazine 11 is preferably arranged to the drilling unit, from which the rods can be connected consecutively to each other by suitable automatic means and to which the drill rods detached from the drill rod system can correspondingly be stored in a manner known per se.

In extension rod drilling, a dulled drill bit is normally replaced when a new hole is started, because then the extension rod combination must in any case be dismantled. When a drill bit is damaged during drilling, the extension rods are dismantled and the drilling unit is driven to the replacement position. After replacing the drill bit, the drilling of the unfinished hole can in most cases be continued, in which case the drilling unit is driven by means of boom control automatics back to the drill hole.

The drill bit replacement is now according to the invention arranged in such a manner that a component magazine 12 is arranged to the boom for the drill bits to be replaced, which magazine can preferably be turned around its axis in direction E and to which magazine drill bits or other necessary components can be stored in a simple manner. Other types of magazines, such as chain-like magazines, can naturally be used, as desired. The magazine shown in the figure can at its simplest be made up of a disciform body 13 on whose periphery pins or corresponding protrusions 14 are arranged, to which the components 15 can be arranged by means of their inner holes. This way, it is easy to grip the outer periphery of the components with a gripping device of the changing unit or another similar handling apparatus. The magazine 12 is preferably arranged in the space between the forks of the boom 4, where it is safe from battering and where it, on the other hand, in no way obstructs visibility or adds to the outer dimensions of the rock drilling apparatus. Because the magazine 12 is not arranged to the drilling unit, the magazine can be made larger, whereby more components than before fit into it. Further, according to the idea of the invention, a changing unit 16 is arranged to the rock drilling apparatus, the changing unit being a kind of a manipulator capable of moving drilling components 15 between the component magazine 12 and the drilling unit 5. The drilling unit is driven to a predefined replacement position for the replacement of components. In modern rock drilling apparatuses, it is known to use automatic, for instance numeric, control means for directing and controlling the boom and the drilling unit automatically according to an exactly designed drilling program. Such a control can now also be utilised when driving the drilling unit to the replacement position. Because the relative position of the component magazine 12 and the drilling unit 5 is exactly known in the replacement position, and further, because the drilling unit is at this point in any case positioned in an advantageous position with respect to replacement, well within the reach of the changing unit, the changing unit 16 need necessarily not move other than relative to the two movement axes, i.e. a minimum of two degrees of freedom is enough. The figure therefore shows a changing unit comprising an arm 17 articulated turnably to the boom at its other end, which arm can be lengthened and shortened in direction F. At the free end of the arm 17, there is a gripping device 18 for gripping the components being handled preferably at their outer periphery. The changing unit 16 can be turned relative to a horizontal turning joint 19 in direction G by means of a hydraulic cylinder 20 or a corresponding actuator, for instance.

The drilling component is replaced in such a manner that the drill rod combination is in the usual manner dismantled automatically rod by rod into the drill rod magazine. Screw joints are usually used between the rods so that the joint can be opened by turning the rock drill. If necessary, the rock drill can be used to hammer open stuck joints. When the last of the drill rods and the drill bit at its end has been pulled out of the drilled hole, the drilling unit 5 is driven to the replacement position for replacing the drill bit, at which stage its position, that is, its location and position, is exactly known at least in relation to the magazine 12. The drilling unit is preferably driven into an upright position, in which case taking the components from the magazine and arranging them for connection to the drilling unit can take place without changing the position of the gripping device. If the gripping device 18 of the changing unit 16 is made turnable, the replacing can also be done when the drilling unit is driven horizontal in relation to the carrier or into a certain angle position. The altitude of the drilling unit should also preferably be arranged in the replacement position in such a manner that the changing unit can replace the component advantageously with respect to the movements of the changing unit. The turning motion of the changing unit is easily restricted by mechanical means, for instance, to a desired position, in which case no separate movement adjustments or sensorings are needed. The lower position of the changing unit arm 17 can also be mechanically restricted with respect to the component magazine 12, in which case the changing unit is arranged to turn along a predefined path between its mechanically restricted extreme positions. Further, the change of the arm's length can be mechanically restricted in the extreme positions by means of a rod 17*a*, for instance, since the distance between the changing unit and the magazine 12 and also between the changing unit and the drilling unit 5 is known in advance. When the positioning movements of the changing unit are arranged as simple as possible in this manner, without a need for exact adjustment of the movements, the structure and operation of the changing unit can be implemented in a very simple manner by applying conventional components which have been proven reliable. It is then not necessary to use complex adjustment and measurement equipment. In addition, the movements of the changing unit can be fast.

The changing unit removes the drill bit from the drill shank 28 and takes it to the component magazine, from which it at the same time takes a new drill bit and takes it to the drilling unit. The drilling component is positioned by means of the changing unit in direction H of the movement axis of the rock drill 7 feed, whereby connecting the drilling component to the drill shank can be done by turning the drill to close the screw joint between the component and the shank. The drill bit is moved by means of the feeding movement of the drill to the end of the feeding beam, to which means have been arranged for keeping a drill bit brought to them in place after the drill bit is detached from the drill shank. After this, the rock drill is driven back to its starting position, and an extension rod can be arranged between the drill bit and the shank. As many extension rods as are required for the current drilling are arranged between the drill bit and the rock drill. Further, it is possible to arrange the changing unit in such a manner that it can take the drill bit directly to the end of the feeding beam for hold, whereby the operation of the equipment becomes faster.

In addition to the solution shown in FIG. 1*a*, it is possible to arrange both the changing unit and the component magazine to the carrier, in which case the location of the changing unit and the magazine are known regardless of the position of the boom. The changing unit can also be arranged to the carrier and the magazine to the boom, or vice versa. In the latter case, the position of the changing unit with respect to the magazine and the control data required for using the changing unit are obtained by means of suitable positioning sensors, for instance. In all cases, the drilling unit is positioned to the replacement position according to the magazine. Depending on the fixing point of the changing unit and the magazine, the movement of the changing unit between the magazine and the drilling unit is controlled either by fixed restrictors or on the basis of information provided by suitable positioning sensors.

Figure 1B:
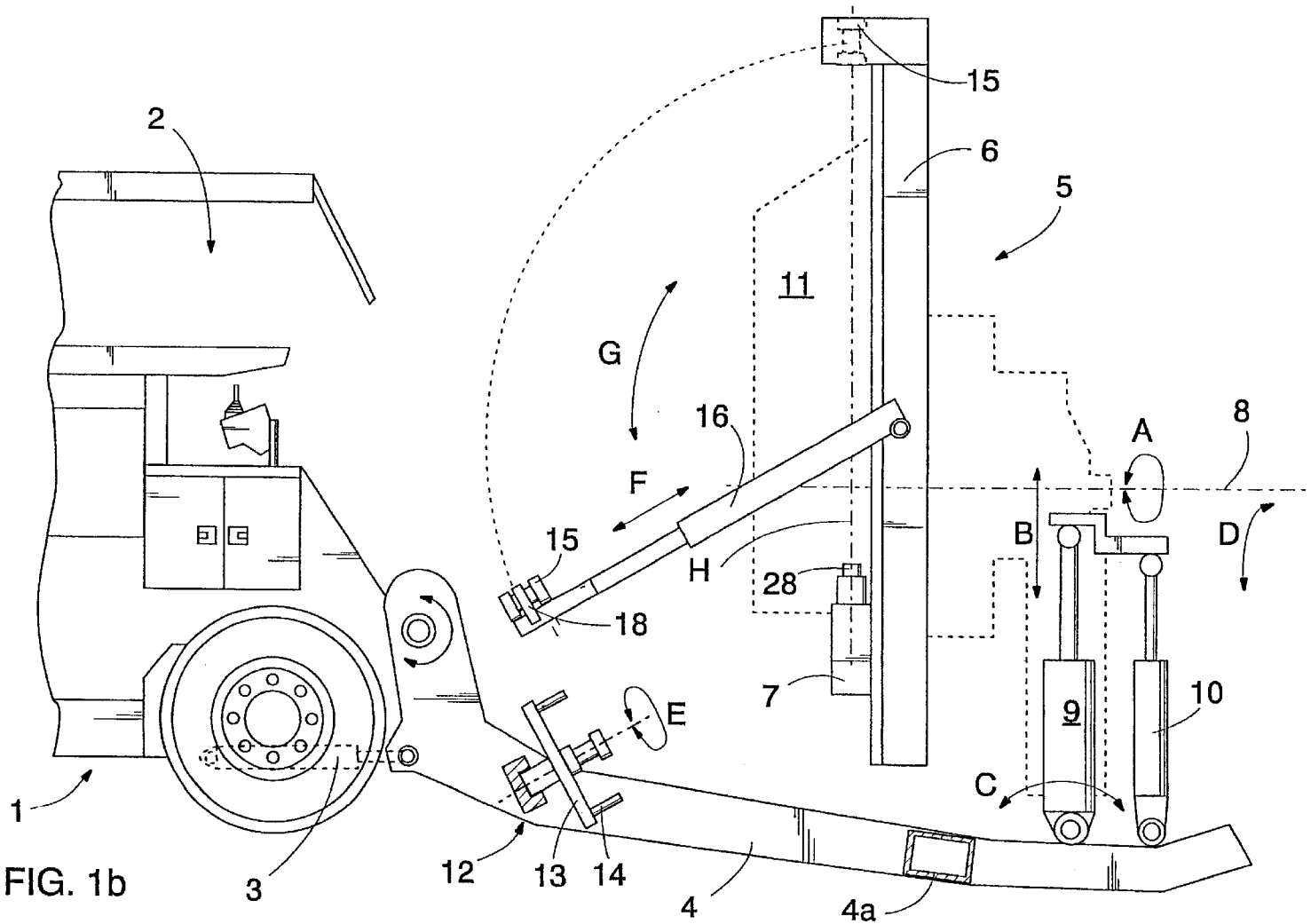

FIG. 1*b* shows a solution in which the changing unit 16 is arranged to the drilling unit 5. The changing unit 16 can then be articulated to the feeding beam 6, for instance, in which case it can take components 15 from the component magazine 12 and take them directly to the end of the feeding beam for hold. A drilling component 15 taken for hold at the end of the feeding beam is shown by a dashed line. For clarity's sake, the figure does not show the actuators used in turning the changing unit 16. This kind of a solution provides the advantage that when a drilling component 15 is taken for hold, the changing unit 16 can be turned without any complex control, since the relative position of the changing unit and the hold station is exactly known and substantially unchanging. Further, because the drilling unit is according to the inventive idea driven to a predefined position and location with respect to the component magazine 12 for replacing the drilling component, the position of the changing unit with respect to the component magazine in replacement position is also exactly known.

Figure 2A:
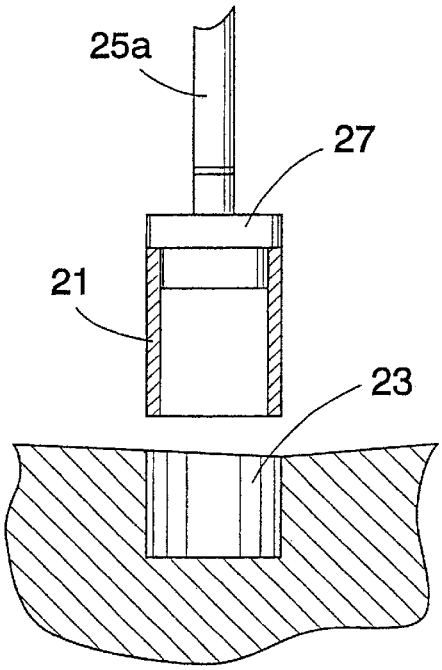
FIGS. 2*a* and 2*b* show schematic views of the principle of installing a drill cuttings pipe used in rock drilling.
Figure 2B:
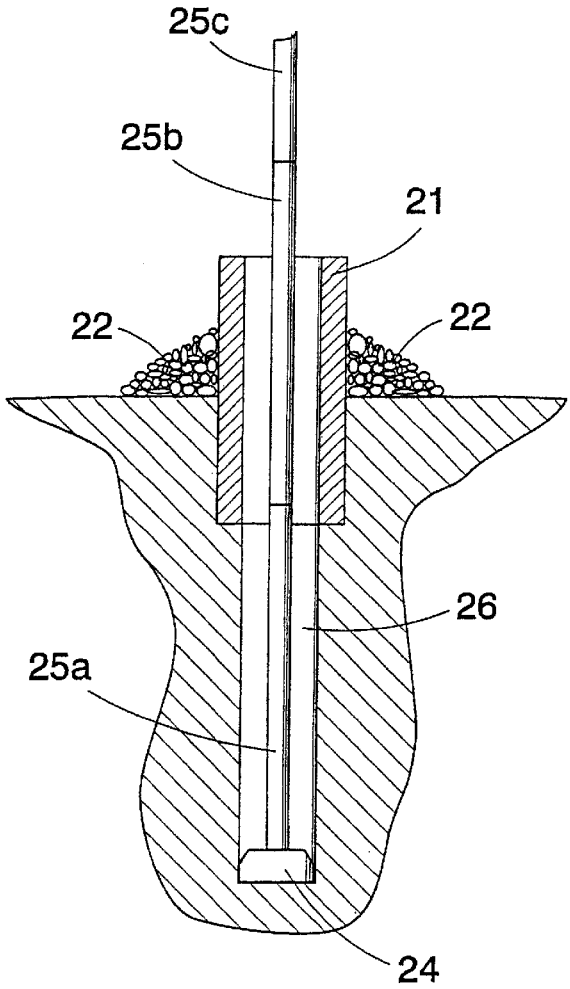

FIG. 2*a* shows the principle of a drill cuttings pipe arranged in a drill hole. The task of the drill cuttings pipe 21 is to prevent drill cuttings 22, i.e. rock chippings created during drilling, brought up by means of a drilling medium during a downward or downward slanting drilling from flowing back down the drilled hole. The drill cuttings pipe in a way forms a high collar around the drilled hole. For installing the drill cuttings pipe 21, a start hole 23 is drilled with a drill bit larger than the actual hole, after which the drill cuttings pipe is partly pushed into the hole as shown in FIG. 2*b*. The inner diameter of the drill cuttings pipe 21 is naturally designed so that the actual drill bit 24 with its extension rods 25*a* to 25*c* can be pushed through it to drill the actual drilling hole 26. This kind of a drill cuttings pipe is typically installed manually, which is slow and awkward and thus not suitable for modern rock drilling. The solution of the invention now also provides an improvement to the installation of drill cuttings pipes. A drill bit with a larger diameter for drilling the hole for the drill cuttings pipe can be stored in and replaced from the component magazine, and a suitable tool for installing the drill cuttings pipe can be arranged on the drill shank after drilling the hole for the drill cuttings pipe. After this, the changing unit fetches the drill cuttings pipe to be installed and brings it to the tool connected to the drill shank, the tool being a kind of a plunger 27, and after this, the drill cuttings pipe 21 brought to the plunger for installation is pushed into the hole 23 by means of the rock drill feeding apparatus. The plunger is then taken back by the changing unit and drilling is continued as usual through the drill cuttings pipe.

It is possible to have more than one magazine, for instance two: a first magazine for the tools, i.e. the drill bits and the plunger for the drill cuttings pipe, and a second magazine for the drill cuttings pipes. The magazines can be as shown in FIG. 1*a*, for instance, and they can be arranged side by side in the space between the boom forks as seen from the front of the rock drill. In such a case, there is also a vertical turning joint with the turning joint 19 of the changing unit so that the changing unit can also turn in sideward direction of the rock drilling apparatus. The sideward movement of the changing unit can also be restricted in its extreme positions. On the other hand, the magazines can be arranged in such a manner that the magazine needed at each time for handling the components is driven to a certain location where the changing unit can handle the components in the magazine. This location of the magazine is also the point according to which the drilling unit is positioned in its replacement position.

The drawings and the description related to them are only intended to illustrate the idea of the invention. The invention may vary in detail within the scope of the claims. Thus, the boom of the rock drill or the drilling unit need not be exactly as described in the figures, but the invention can be applied to other kinds of rock drilling apparatuses. Further, differing from what is shown in the figure, the changing unit can be arranged to turn horizontally only, in which case the component magazine can be arranged to the carrier behind the control cabin, for instance. Replacing components with the changing unit then requires at its simplest only turning the changing unit to a certain angle horizontally and lengthening its arm. It should also be noted that the solution of the invention can well be applied to other situations than just to replacing drill bits or the like in extension rod drilling. The arrangement of the invention thus does not necessarily at all comprise a drill rod cartridge or it may be located elsewhere than with the drilling unit.

What is claimed is:

1. An arrangement for replacing a drilling component in a rock drilling apparatus comprising:

a carrier, a boom, the boom being maneuverably connected to the carrier, a drilling unit, the drilling unit being maneuverably connected to the boom for pivotable movement about a plurality of axes for driving the drilling unit to a drilling position, the drilling unit comprising at least a rock drill, a feeding beam and feeding means, at least one component magazine separate from the drilling unit for storing drilling components required in drilling and a changing unit for handling the drilling components between the component magazine and the drilling unit, and means for driving the drilling unit to a predefined position and location with respect to the component magazine for replacing a drilling component.

2. An arrangement as claimed in claim 1, wherein the changing unit is connected to the carrier.

3. An arrangement as claimed in claim 1, wherein the changing unit is arranged to turn relative to its turning joint between the component magazine and the drilling unit, and the changing unit comprises an arm capable of being lengthened or shortened, and a free end of the arm comprises a gripping device for gripping the drilling components.

4. An arrangement as claimed in claim 1, wherein a hold station is at an end of the feeding beam, the changing unit is connected to the drilling unit and the changing unit is arranged to handle the drilling components between the component magazine and the hold station.

5. An arrangement for replacing a drilling component in a rock drilling apparatus comprising:

a carrier, a boom, the boom being maneuverably connected to the carrier, a drilling unit, the drilling unit being maneuverably connected to the boom, the drilling unit comprising at least a rock drill, a feeding beam and feeding means, at least one component magazine separate from the drilling unit for storing drilling components required in drilling and a changing unit for handling the drilling components between the component magazine and the drilling unit, and means for driving the drilling unit to a predefined position and location with respect to the component magazine for replacing a drilling component, wherein the changing unit is connected to the boom.

6. An arrangement for replacing a drilling component in a rock drilling apparatus comprising:

a carrier, a boom, the boom being maneuverably connected to the carrier, a drilling unit, the drilling unit being maneuverably connected to the boom, the drilling unit comprising at least a rock drill, a feeding beam and feeding means, at least one component magazine separate from the drilling unit for storing drilling components required in drilling and a changing unit for handling the drilling components between the component magazine and the drilling unit, and means for driving the drilling unit to a predefined position and location with respect to the component magazine for replacing a drilling component, wherein the component magazine and the changing unit are connected to the boom, and a relative position of the component magazine, changing unit and drilling unit is independent of a position of the boom.

7. An arrangement as claimed in claim 6, wherein movements of the changing unit are mechanically restricted according to the relative position of the predefined replacement position of the drilling unit and the component magazine.

8. An arrangement for replacing a drilling component in a rock drilling apparatus comprising:

a carrier, a boom, the boom being maneuverably connected to the carrier, a drilling unit, the drilling unit being maneuverably connected to the boom, the drilling unit comprising at least a rock drill, a feeding beam and feeding means, at least one component magazine separate from the drilling unit for storing drilling components required in drilling and a changing unit for handling the drilling components between the component magazine and the drilling unit, and means for driving the drilling unit to a predefined position and location with respect to the component magazine for replacing a drilling component, wherein the component magazine comprises a turnable body on a periphery of which protrusions are arranged for holding the drilling components.

9. An arrangement for replacing a drilling component in a rock drilling apparatus comprising:

a carrier, a boom, the boom being maneuverably connected to the carrier, a drilling unit, the drilling unit being maneuverably connected to the boom, the drilling unit comprising at least a rock drill, a feeding beam and feeding means, at least one component magazine separate from the drilling unit for storing drilling components required in drilling and a changing unit for handling the drilling components between the component magazine and the drilling unit, and means for driving the drilling unit to a predefined position and location with respect to the component magazine for replacing a drilling component, wherein the boom comprises two beams longitudinal to the rock drilling apparatus at a distance from each other and the component magazine and the changing unit are arranged between the beams of the boom.

* * * * *